US007901260B2

(12) United States Patent
Godoy

(10) Patent No.: US 7,901,260 B2
(45) Date of Patent: Mar. 8, 2011

(54) SWIMMING FIN WITH HEEL STRAP FASTENING BUCKLE

(75) Inventor: Carlos Godoy, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 0 days.

(21) Appl. No.: 12/454,477

(22) Filed: May 19, 2009

(65) Prior Publication Data

US 2009/0305587 A1 Dec. 10, 2009

(51) Int. Cl.
*A63B 31/11* (2006.01)

(52) U.S. Cl. ..... 441/64

(58) Field of Classification Search ..... 441/61, 441/62, 63, 64

See application file for complete search history.

(56) References Cited

U.S. PATENT DOCUMENTS

| | | | | | |
|---|---|---|---|---|---|
| 4,251,894 | A | | 2/1981 | Hollingsworth | 9/309 |
| 4,670,946 | A | | 6/1987 | Olivieri | 24/71 SK |
| 4,795,384 | A | * | 1/1989 | Hattori | 441/64 |
| 4,887,985 | A | | 12/1989 | Garofalo | 441/64 |
| 5,304,081 | A | | 4/1994 | Takizawa | 441/64 |
| D350,801 | S | | 9/1994 | Dagnino | D21/239 |
| 5,358,439 | A | | 10/1994 | Paolo | 441/64 |
| 5,443,593 | A | | 8/1995 | Garofalo | 441/64 |
| 5,467,508 | A | | 11/1995 | Feng | 24/68 SK |
| 5,542,865 | A | | 8/1996 | Alvarez De Toledo | 441/64 |
| 5,545,067 | A | * | 8/1996 | Garofalo | 441/64 |
| 5,588,890 | A | | 12/1996 | Garofalo | 441/64 |
| 5,607,334 | A | | 3/1997 | Garofalo | 441/64 |
| D382,322 | S | | 8/1997 | Cressi | D21/239 |
| D421,474 | S | | 3/2000 | Godoy | D21/806 |
| 6,224,443 | B1 | | 5/2001 | Mehrmann et al. | 441/64 |
| 6,364,728 | B1 | | 4/2002 | Viale et al. | 441/64 |
| 6,398,604 | B1 | | 6/2002 | Kawashima et al. | 441/64 |
| 6,568,973 | B2 | | 5/2003 | Testa | 441/64 |
| 6,568,974 | B2 | | 5/2003 | Semeia | 441/64 |
| 6,640,396 | B1 | | 11/2003 | Lin | 24/68 SK |

(Continued)

FOREIGN PATENT DOCUMENTS

DE 2712737 9/1978

(Continued)

OTHER PUBLICATIONS

Kiefer, Fall, 2002, pp. 72 and 73, swimming fins, www.kiefer.com.

(Continued)

*Primary Examiner* — Daniel V Venne
(74) *Attorney, Agent, or Firm* — Pollack, P.C.

(57) ABSTRACT

A swimming fin comprising a blade extending from a shoe open at its rear side, and a rear heel strap connected to the sides of the shoe by at least one buckle, the buckle having a base plate integral with the shoe. A buckle arm is joined with the strap so as to allow adjustment of the strap's tension, an intermediate lever being connected pivotally to the base plate and the arm. A reversible attachment member is also provided for connecting the intermediate lever to the base plate to achieve closure of the buckle. Between the intermediate lever and the base plate, a disengageable articulation member is provided for reciprocal engagement between them, a pivotal connection, and, at the same time, for allowing their separation in a direction opposite to that of tensioning the strap. In this manner, the intermediate lever may be separated from the base plate following release of the attachment member, and disconnection of the disengageable articulation member.

1 Claim, 4 Drawing Sheets

U.S. PATENT DOCUMENTS

| | | | | |
|---|---|---|---|---|
| D490,136 | S | 5/2004 | Godoy | D21/806 |
| 2005/0246868 | A1 | 11/2005 | Garofalo et al. | 24/170 |

FOREIGN PATENT DOCUMENTS

| | | | |
|---|---|---|---|
| EP | 0070272 | A1 | 1/1983 |
| EP | 0070272 | B1 | 12/1984 |
| EP | 0308998 | | 3/1989 |
| EP | 0484846 | A2 | 5/1992 |
| EP | 09607568 | | 7/1994 |
| EP | 0687484 | A1 | 12/1995 |
| EP | 0985431 | | 3/2000 |
| EP | 0998962 | | 5/2000 |
| EP | 1192974 | A2 | 4/2002 |
| EP | 1192974 | A3 | 5/2002 |
| FR | 1426740 | | 1/1966 |
| GB | 2148438 | A | 5/1985 |

OTHER PUBLICATIONS

European Search Report, dated Jan. 15, 2007, for European Patent Application No. EP 06 12 0864.

* cited by examiner

SWIMMING FIN WITH HEEL STRAP FASTENING BUCKLE

FIELD OF THE INVENTION

The present invention relates generally to articles for self-propulsion and, more particularly, to foot mounted articles for effecting movement through fluid media or the like.

BACKGROUND OF THE INVENTION

Conventional buckles for swimming fins include, for example, two parts: a first part connected to a side of the shoe and a second part joined to a strap, the first and second parts being in snap engagement with one another. While useful, buckles of this type have been found disadvantageous in that they must necessarily be loosened to enable the fin to be put on the user's foot, and require adjustment of strap tension each time the fin is put on.

A buckle for swimming fins that can be opened without separating it into two separate parts is described in European patent no. 687484 that is inspired by prior solutions already in use in the field of sports equipment. According to this patent the part of the buckle integral with the side of the shoe and the part attached to the end of the strap are articulated to each other via a connection lever that allows the buckle part connected to the strap to be moved from a position of attachment on the buckle part connected to the side of the shoe, at which the strap tightens the foot of the user at the rear, to a position of disengagement wherein the buckle part whereto the strap is attached is moved backwards in relation to the fixed part, eliminating the tension of the strap and thus allowing the user to put the fin on or take it off. With this system it is not possible to separate the parts that make up the buckle, and therefore it is not possible to separate the strap from the fin. Consequently, a first disadvantage of this known device consists in that the user, in order to take the fin off, albeit with the strap loosened, must always remove it from the foot: i.e. it is necessary to make the loosened strap pass behind the heel, with the aid if necessary, of his/her hand, which may delay the operation in emergency conditions.

In the buckle described in the aforementioned European patent the buckle part connected to the strap is attached to the buckle part integral with the shoe by means of a snap connection, both during the opening phase and the closure phase, between the intermediate articulation lever and a pair of side flanges rising up from the buckle part integral with the shoe. In order to open the buckle the user has to push the free end of the lever outwards.

A second disadvantage of this device consists in that such a closure system is not totally safe, in that the opening movement may also be caused accidentally in the case of impact or in the case wherein the free end of the lever tangles in some external projection.

A third disadvantage of this device consists in that, after having worn the fin and closed the buckle, the tension of the strap can be increased but not decreased. With the fin on, the strap provides a tight length adhering to the foot and a free end which can be grasped and pulled to increase the tension of the strap. In order to loosen the tension a few fingers have to be inserted between the foot of the user and the tight strap, which is anything but easy. Therefore, in order to loosen a strap which, once worn, would appear too tight, the strap has to be opened and the adjustment operation repeated.

OBJECTS AND SUMMARY OF THE INVENTION

Accordingly, it is an object of the present invention to provide a swimming fin with a heel strap fastening buckle that avoids the necessity of loosening the strap to enable the user to put on the fin and then adjust the strap tension.

A particular object of the present invention is to provide a swimming fin with heel strap fastening buckle that allows the foot to be removed from the shoe, and therefore from the fin, without the need to have to push the loosened strap under the heel.

A further object of the present invention is to provide a swimming fin of the aforementioned type which does not have the risk of accidental opening of the buckle, for example due to an impact, in that the opening of the buckle and its disengagement from the fin require the user to actuate at least one fastening device, acting as a safety actuator.

Another object of the present invention is to provide a swimming fin with a heel strap fastening buckle of the type mentioned above wherein it is possible to loosen the strap without opening the buckle by partially rotating a buckle element connected to the strap.

These objects are achieved with the swimming fin with a heel strap fastening buckle according to the present invention, said buckle comprising a base plate integral with the shoe, an arm connected to the strap to enable an user to adjust the tension thereof and an intermediate lever pivotally connected to the base plate and to said arm, reversible attachment means being also provided for hooking said intermediate lever to said base plate to achieve closure of the buckle. According to the invention, between the intermediate lever and the base plate disengageable articulation means are provided, for creating reciprocal engagement between them and the pivotal connection and, at the same time, allowing their separation in the direction opposite that of tensioning of the strap, so that the intermediate lever can be separated from the base plate following release of the attachment means and the disconnection of the disengageable articulation means.

The disengageable articulation means preferably comprise at least one cavity with an at least partly circular internal profile formed on at least one shoulder rising up from the base plate, said cavity being closed at the side turned towards the arm connected to the strap and open at the opposite side, and at least one projection of the intermediate lever for engaging in said cavity and having a complementary shape to allow reciprocal rotation. In particular, two opposite housings are provided wherein corresponding end portions of the lever pivotally engage, these housings being open at one of their sides, so that the lever end portions can be withdrawn therefrom to separate the lever from the base plate.

The means for reversible attachment of the intermediate lever to the base plate preferably comprise at least one first connection element provided on the intermediate lever, which can be snap engaged, during closure, with at least one second complementary connection element formed in the thickness of the base plate. At least one pushbutton, which can be actuated by the user to release the buckle, is provided on the first connection element placed on said lever. In particular the attachment means comprise two hook arms projecting from a face of the lever and elastically urging against each other, while on the base plate at least one window and two opposite, internally projecting teeth are correspondingly provided, said hook arms snap engaging thereon.

The hook arms extend from respective pushbuttons between which elastic means are placed for keeping them in a sideways projecting position from the lever. In this position the hook arms are engaged on the teeth of the base plate, while the pushbuttons slide one towards the other transversely to the lever, whereby when the pushbuttons are pressed with the fingers of one hand to overcome the resistance of the elastic means placed between them, it is possible to move the hook arms away from the respective teeth and release the buckle.

BRIEF DESCRIPTION OF THE DRAWINGS

A specific, illustrative swimming fin, according to the present invention, described below with reference to the accompanying drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
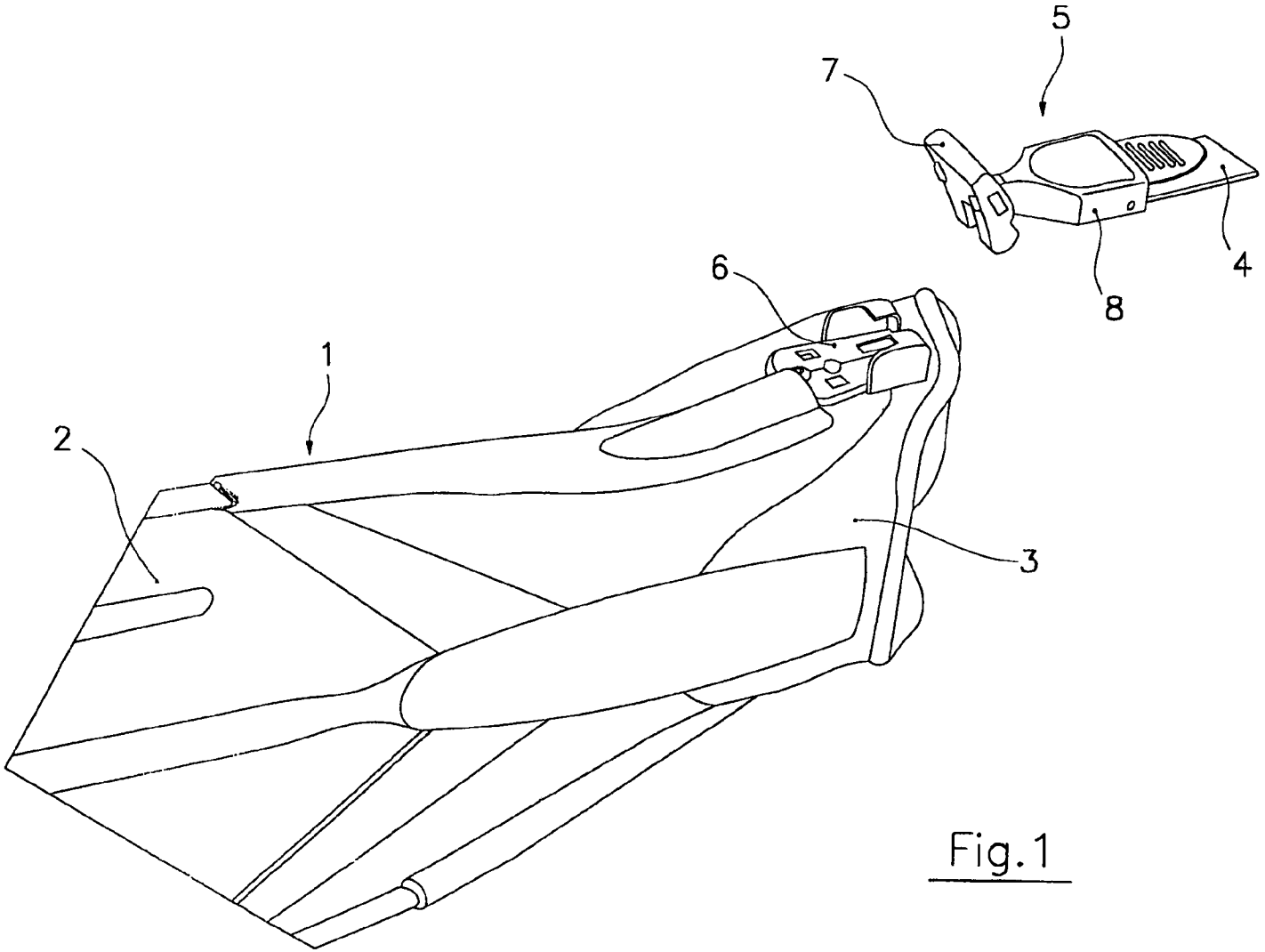
FIG. 1 is a partial perspective view of a swimming fin, according to one aspect of the present invention.

Referring now to the drawings and, more particularly, to FIGS. 1-13, there is shown generally a specific, illustrative swimming fin 1, according to various aspects of the present invention. In one embodiment, illustrated in FIG. 1, the swimming fin comprises a blade 2 extending from a shoe 3 of a type that is open at the rear end, and a heel strap 4 for securing the fin to a user's foot. Ends of the strap are preferably connected to respective buckles 5 attached externally to, e.g., sides of, the shoe.

Figure 2:
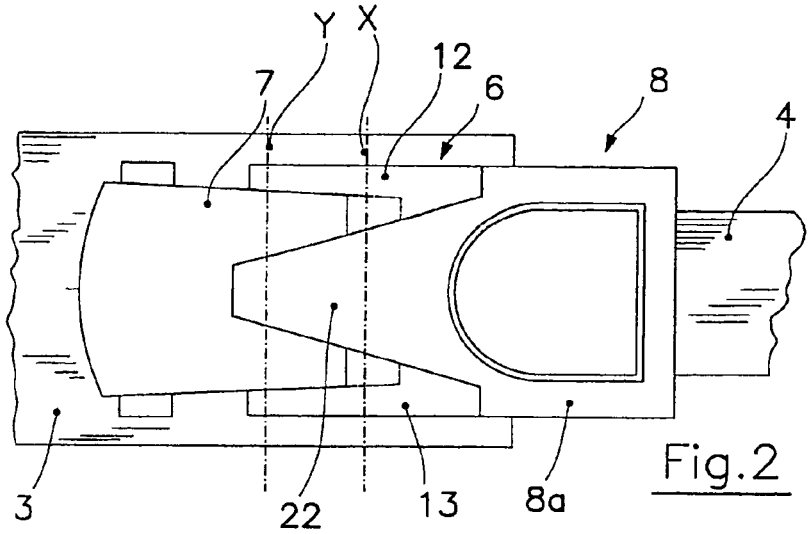
FIG. 2 is a plan view of the buckle set forth in FIG. 1, in a closed position.
Figure 3:
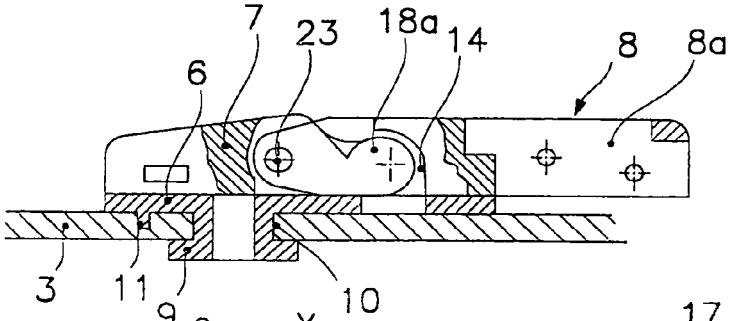
FIG. 3 is a partial sectional view, taken longitudinally, of the buckle shown in FIG. 2.

As shown in FIGS. 2 and 3, the buckle 5 comprises a base plate 6 integral with one side of the shoe 3, an intermediate lever 7 that can be connected reversibly to the base plate 6 at its front end and articulated to the same base plate at its rear end, and a buckle arm 8 hinged with its front end in an intermediate point of the lever 7 and connected to the strap 4 that extends from its opposite end. The axes of hinging of the lever 7 to the base plate 6 and of the arm 8 to the lever 7, denoted by X and Y respectively in FIG. 2, are parallel. The terms "front" and "rear" refer to the relative position of the fin in relation to the foot of the user.

The base plate 6 is attached to the side of the shoe 3 by means of a pin 9 with a butterfly-shaped flange which can be engaged, rotated through 90° in relation to its working position, in a seat 10 correspondingly shaped to allow its anchorage to the base plate 6 and its disengagement therefrom by rotation through 90°. A further stop pin 11, which can be locked with a special tool, prevents rotation of the base plate from its working position. Stop pin 11 and pin 9 extend from the same face of the base plate 6. Stop pin 11 engages in a corresponding seat formed on the side of the shoe 3.

Figure 4:
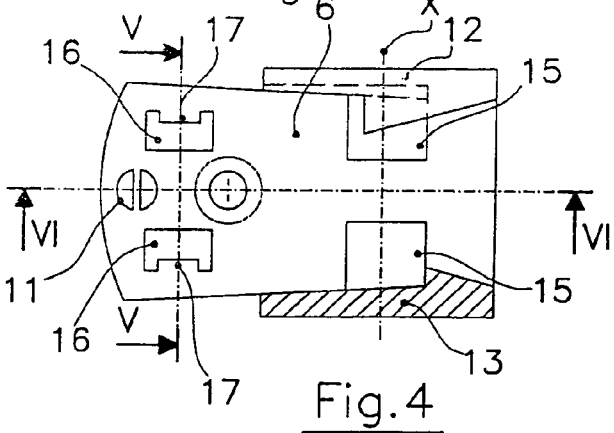
FIG. 4 is a sectional view taken along line IV-IV of FIG. 5 showing a buckle base plate integral with the fin.
Figure 5:
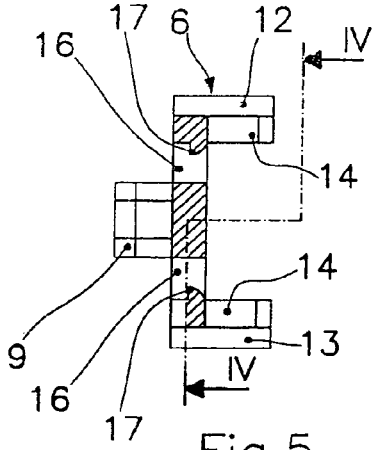
FIG. 5 is a sectional view of the buckle base plate taken along line V-V of FIG. 4.
Figure 6:
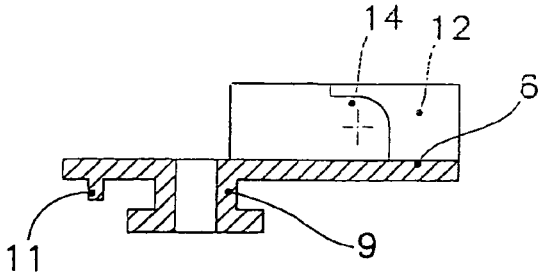
FIG. 6 is a sectional view of the buckle base plate taken along line VI-VI of FIG. 4.

Referring also to FIGS. 4, 5 and 6, from the opposite face of the base plate 6 two opposite side shoulders 12 and 13 rise up. Each shoulder defines, on its internal side, a housing 14 turned towards the other shoulder with a profile that is at least partially circular, closed at its rear side, i.e. towards the arm 8, and open at its front side. At the two housings 14 two windows 15 are formed on the base plate with the purpose of facilitating engaging and disengaging of the intermediate lever. On the plate 6 two further windows 16 are formed in which respective opposite teeth 17 project whose function will be described herein below.

Figure 7:
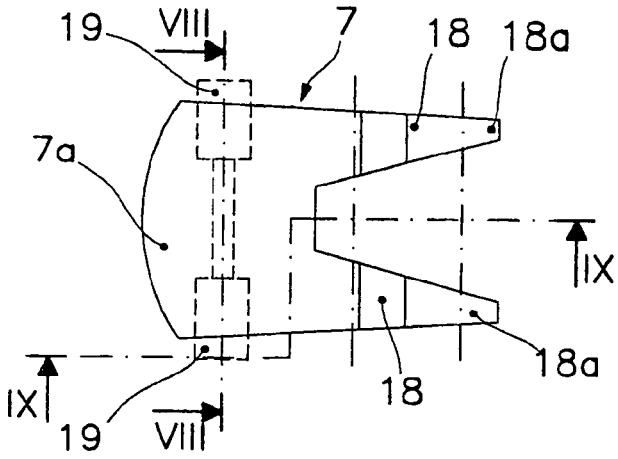
FIG. 7 is a plan view of an intermediate lever of a buckle mounted to a swimming fin, according to one aspect of the present invention.
Figure 8:
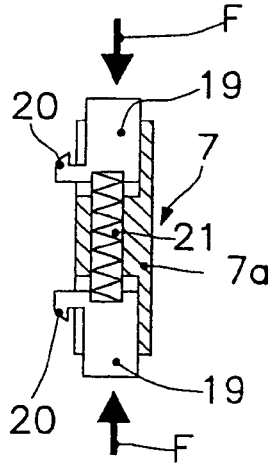
FIG. 8 is a sectional view of the intermediate lever taken along line VIII-VIII of FIG. 7.
Figure 9:
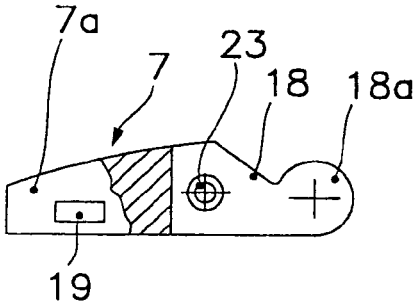
FIG. 9 is a sectional view of the intermediate lever taken along line IX-IX of FIG. 7.

Turning now to FIGS. 7, 8 and 9, the lever 7 is preferably formed by a front body 7*a*. Two arms or articulation members 18 extend rearwardly from sides of the front body, the arms each having an expansion 18*a* with a circular shape at its end. The circular expansions engage housings 14, as shown in FIG. 3, allowing rotation of the lever relative to base plate 6, in a manner illustrated generally in FIG. 12. Because the housings are open on their front side, the circular expansions engage freely with the housings, such that the lever may be completely separated from the base plate in a direction opposite to that of tension of the strap.

Due to the fact that the housings 14 have the front side open, the circular expansions 18*a* freely engage in the housings 14 whereby the lever 7 can be separated from the base plate 6 as will be described herein below.

Near the opposite end of the lever, relative to the circular expansions, a hand operated lock member is provided, the lock member comprising a pair of push-buttons 19 projecting laterally from opposing sides of the lever body and sliding transversely relative thereto. According to one embodiment, the lock member also includes hook arms 20 extending from the push-buttons, respectively, toward the base plate for engagement with teeth 17, described above, which project into windows 16 of the base plate. An arrangement of this general description is illustrated in FIGS. 4 and 5. As shown in FIG. 8, a spring 21 is positioned between the push-buttons and extends generally transversely into a seat of lever body 7*a* so as to maintain them in an externally projecting position. In this manner, when the hook arms are engaged with the teeth, the lever is joined securely to the base plate. By pressing the push-buttons simultaneously, such as using two fingers of one hand, in a direction shown by arrows F in FIG. 8 to push them toward one another, the elastic resistance of spring 21 is overcome and hook arms 20 are caused to disengage from teeth 17, thereby releasing intermediate lever 7 from base plate 6. The intermediate lever can then attain the position shown in FIG. 12. In a subsequent position, shown in FIG. 13, the buckle is completely open and disengaged from the fin.

Figure 10:
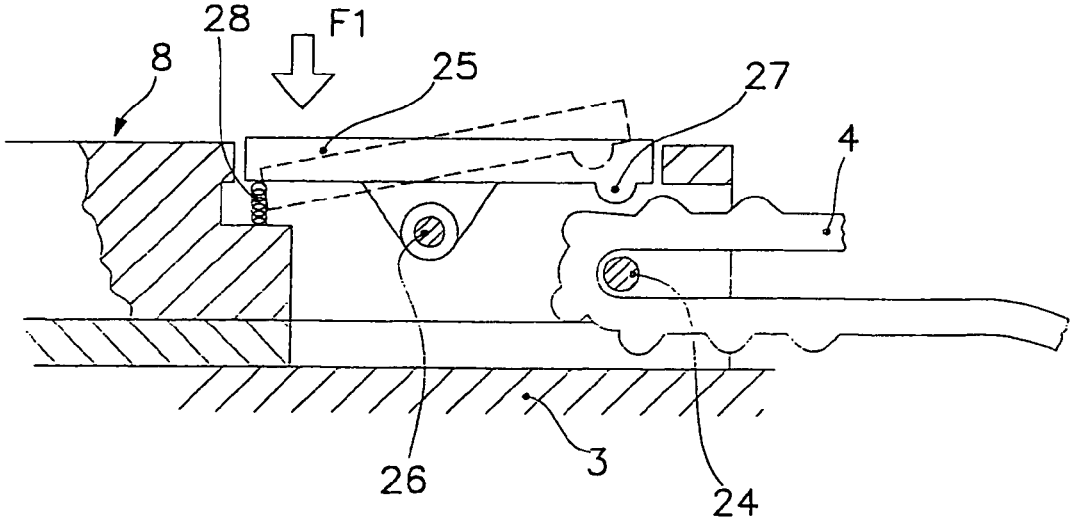
FIG. 10 shows a partial, enlarged, longitudinal cross section of a buckle arm integral with the strap, according to one aspect of the present invention.
Figure 11:
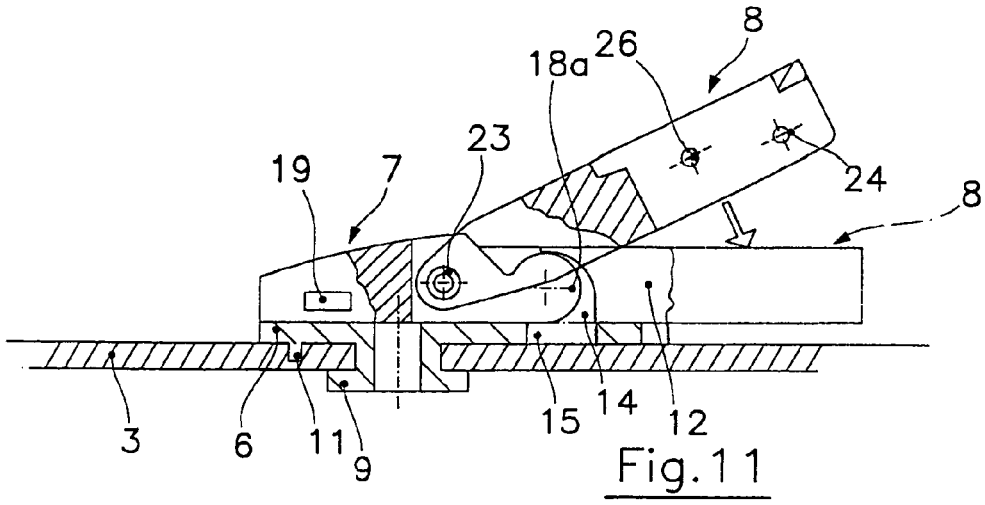
FIG. 11 shows a longitudinal and partial sectional view of the buckle, according to one aspect of the present invention, in a position in which, when the buckle is closed, the buckle arm joined to the strap may be loosened by its partial rotation, a dotted line indicating the arm in a closed, normal working position.

Referring to FIGS. 2, 3 and 10, the arm 8 for connection to the strap is formed at its rear side by a substantially box-shaped portion 8*a*, in which one end of the strap 4 engages, and by a wing 22 extending from its opposite end between the arms 18 of the lever 7 and articulated to the lever 7 through a pin 23. As shown in FIG. 10, the strap 4 is engaged as usual in the box-shaped portion 8*a* of the arm 8, in particular being wound on a transverse pin 24 placed therein. The box-shaped portion 8*a* also comprises a pushbutton 25 hinged on a second transverse pin 26 also placed in the box-shaped portion 8*a*. A tooth 27 extends from the internal face of the pushbutton 25 to engage between the ribs of the strap 4 allowing the locking thereof in the required position, while on the diametrically opposite side between the pushbutton 25 and the box-shaped portion 8*a* a spring 28 is placed to force the tooth 27 against the strap 4 and prevent sliding of the strap. The state of tension of the strap 4 is adjusted as usual by pressing the pushbutton 25 in the direction of the arrow F1 so as to overcome the elastic resistance of the spring 28 and disengage the tooth 27 from the transverse ribs of the strap 4, which can therefore be slid freely around the transverse pin 24 to loosen it or tensioning it. It should in fact be noted that in the position of the arm 8 shown in FIG. 11 the buckle remains integral with the fin; nevertheless it is possible to loosen the strap.

Figure 12:
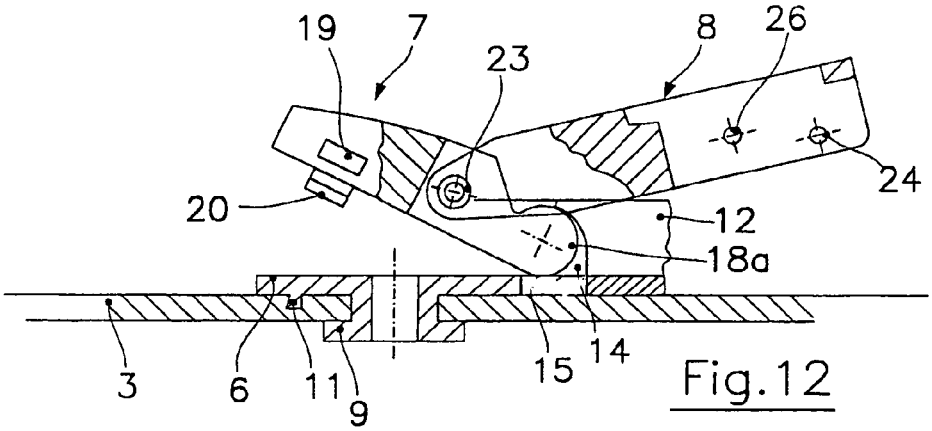
FIG. 12 shows a partial, longitudinal sectional view of a buckle, in a first phase of opening.
Figure 13:
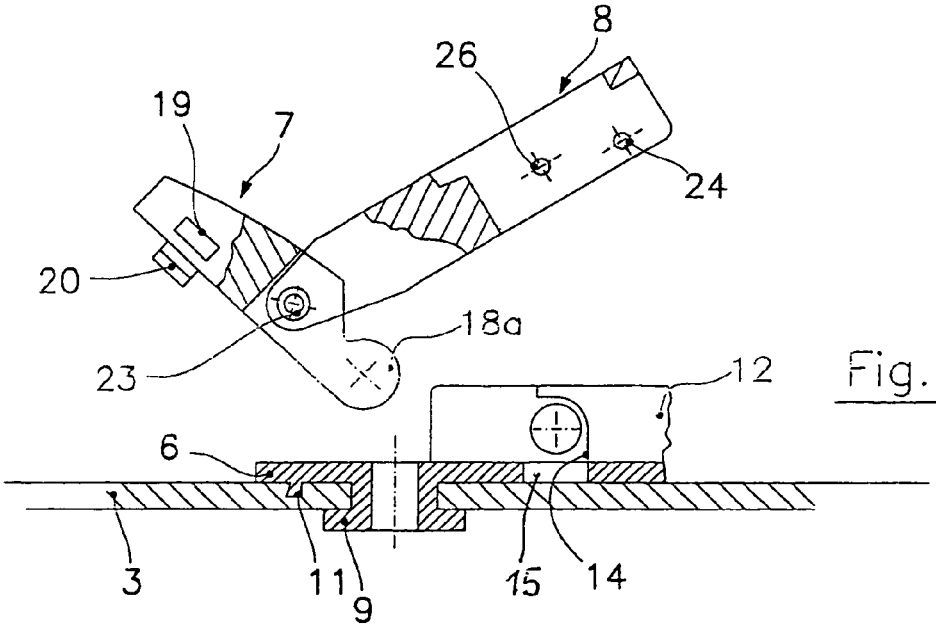
FIG. 13 shows a second phase of opening the buckle set forth in FIG. 11 with an intermediate lever, and having the buckle arm integral with the strap released from the base plate and integral with the shoe, according to another aspect of the present invention.

FIGS. 3, 12 and 13 show how the buckle mounted on the fin of the invention works, when the buckle is to be opened without altering the tension of the strap. In particular, it is noted that in order to change from the condition shown in FIG. 3, wherein the buckle is closed and the lever 7 is connected to the base plate 6, to that shown in FIG. 12, wherein the lever 7 has been released from the base plate 6 by disengaging the hook arms 20 from the respective teeth 17 of the base plate 6, it is necessary to press the pushbuttons 19 with two fingers of the same hand. In FIG. 12 the intermediate lever 7 is released at its front end from the base plate, but is still articulated to the latter at its rear end; by disengaging the circular expansions 18*a* of the arms 18 of the lever 7 from the housings 14 of the base plate 6 the buckle is completely opened as shown in FIG. 13. It will be noted that, although the articulation between the base plate 6 and the lever 7 through the circular expansions 18*a* engaged in the housings 14 is an unrestrained connection, this would in any case be ensured by the state of tension of the strap 4 which, in the conditions of FIG. 3, in fact prevents disengaging from the housing 14 except in the case of accidental impact which could bring the intermediate lever 7 into the position shown in FIG. 12. According to the invention this risk is avoided with the reversible attachment device formed by all the elements 17, 19, 20 and 21, which can only be opened deliberately by the user.

Various modifications and alterations may be appreciated based on a review of this disclosure. These changes and additions are intended to be within the scope and spirit of the invention as defined by the following claims. For example, the reversible attachment member, formed by elements 17, 19, 20 and 21—that can be actuated using two fingers of the same hand via opposing push-buttons 19 and thereby act as a safety device, may be replaced by a single push-button located transversely, or in a front central part, of lever 7 and, in any case, preferably in a position where it is protected from accidental impact.

The invention claimed is:

1. A swimming fin having a blade extending from a shoe open at a rear side thereof and a rear heel strap connected to sides of the shoe by at least one buckle, the buckle comprising a base plate integral with the shoe, a buckle arm joined with the strap so as to allow adjustment of the strap's tension, an intermediate lever connected pivotally both to the base plate and the arm, a hand controlled lock member for joining one end of the lever to the base plate so as to close the buckle, and an articulation member joining another end of the lever to the base plate so as to achieve reciprocal engagement with, and pivotal connection between, the other end of the lever and the base plate, while allowing complete separation of the lever from the base plate in a direction opposite to that of tensioning of the strap, whereby, upon release of the lock member and disengagement of the articulation member from the base plate, the lever separates completely from the base plate, thereby opening the buckle, and whereby, upon rotating the arm relative to the lever such that the lock member is in a closed position and the lever is secured to the base plate, closing of the buckle is achieved.

* * * * *